US006789698B2

(12) United States Patent
Gloor et al.

(10) Patent No.: US 6,789,698 B2
(45) Date of Patent: Sep. 14, 2004

(54) DEVICE BY MEANS OF WHICH A SUPPLY CONTAINER IS CONNECTED IN A SEALED MANNER TO A CONSUMER ELEMENT, AND CONSUMER ELEMENT

(75) Inventors: Herbert Gloor, Unterkulm (CH); Zlatko Valentin, Granichen (CH); Werner Hugger, Unterkulm (CH)

(73) Assignee: KWC AG, Unterkulm (CH)

( * ) Notice: Subject to any disclaimer, the term of this patent is extended or adjusted under 35 U.S.C. 154(b) by 0 days.

(21) Appl. No.: 10/340,793

(22) Filed: Jan. 13, 2003

(65) Prior Publication Data

US 2003/0140984 A1 Jul. 31, 2003

(30) Foreign Application Priority Data

Jan. 23, 2002 (EP) ..... 02001542

(51) Int. Cl.[7] ..... B67B 7/00

(52) U.S. Cl. ..... 222/5; 222/83.5; 222/542; 141/14; 141/18; 141/19; 141/352

(58) Field of Search ..... 141/14, 17–19, 141/2–4, 346, 351–354; 22/5, 81, 83, 83.5, 88–91, 542

(56) References Cited

U.S. PATENT DOCUMENTS

| | | | | |
|---|---|---|---|---|
| 3,938,704 A | * | 2/1976 | Milgram | 222/5 |
| 4,150,656 A | * | 4/1979 | Curran | 124/74 |
| 4,177,828 A | | 12/1979 | Vache | |
| 4,189,068 A | | 2/1980 | Apellaniz | |

FOREIGN PATENT DOCUMENTS

| | | |
|---|---|---|
| EP | 0 134 062 B1 | 3/1985 |
| EP | 0 238 312 B1 | 9/1987 |
| EP | 2 252 379 A1 | 1/1988 |
| EP | 0 472 995 B1 | 3/1992 |
| FR | 1038427 | 9/1953 |
| WO | WO 01/20218 A1 | 3/2001 |

* cited by examiner

*Primary Examiner*—J. Casimer Jacyna
(74) *Attorney, Agent, or Firm*—Oliff & Berridge, PLC

(57) ABSTRACT

Device by means of which a supply container subjected to positive pressure is connected in a sealed manner to a consumer element with the aid of a sealing element, sealing in the direction of the surroundings taking place before an opening element opens the valve of the supply container. This is realized by a sealing element which, as measured in the longitudinal direction (L) from the base of the cutout, is wider than the opening element, and by an amount of play, which allows the sealing element to accommodate the full displacement.

12 Claims, 3 Drawing Sheets

DEVICE BY MEANS OF WHICH A SUPPLY CONTAINER IS CONNECTED IN A SEALED MANNER TO A CONSUMER ELEMENT, AND CONSUMER ELEMENT

BACKGROUND OF THE INVENTION

1. Field of Invention

The invention relates to a device by means of which a supply container containing a medium subjected to positive pressure is connected in a sealed manner to a consumer element, and to a consumer element for such a device.

2. Description of Related Art

In the case of devices of this type, for example in the case of the so-called "Soda-Club®", a device for carbonating drinks, a flat sealing ring butts against a base of a cutout of a consumer element. When a connection element arranged on a supply container is screwed into a thread of the consumer element, an end side of the connection element comes into abutment against the sealing ring and is forced against the same. This provides sealing between a valve of the supply container and the surroundings. It may be the case here that full sealing in the direction of the surroundings only takes place shortly after the valve of the supply container has been opened, by an opening pin fitted in the consumer element.

The disadvantage of this device is that, during the screwing-in operation of the supply container, part of the medium located therein is lost if full sealing in the direction of the surroundings only takes place once the valve of the supply container has been opened. If the medium located in the supply container is, for example, a gas, the action of the gas flowing out rapidly into the surroundings produces a noise which may give individuals who are not prepared for it a fright. If the medium located in the supply container is a liquid, the latter contaminates the internal thread of the consumer element as it flows out.

SUMMARY OF THE INVENTION

The object of the present invention is to provide a device of the type mentioned in the introduction and a consumer element which reliably prevent the medium from escaping.

The present invention has the advantage that opening of the valve takes place without any losses and more or less without any sound. This is achieved, in particular, by a specific form of sealing element. The sealing element is in fixed and dirt-impermeable abutment against a base of a cutout of the consumer element. The sealing element here is configured such that sealing between the valve of the supply container and the surroundings is produced before the valve of the supply container is opened.

The invention can be used particularly advantageously for carbonating drinks. In this case, the supply container contains pressurized carbon dioxide and the consumer element has a pressure-reducing element which reduces the pressure of the gas flowing out into the drink.

Further preferred embodiments are specified below.

BRIEF DESCRIPTION OF THE DRAWINGS

The invention is explained hereinbelow with reference to the drawings, wherein.

DETAILED DESCRIPTION OF PREFERRED EMBODIMENTS

Parts which function in the same way are indicated in the figures by the same designations.

Orientation of the figures is provided by the designations of the same. The terms left and right, and top and bottom, are to be understood in respect of this orientation.

Figure 1:
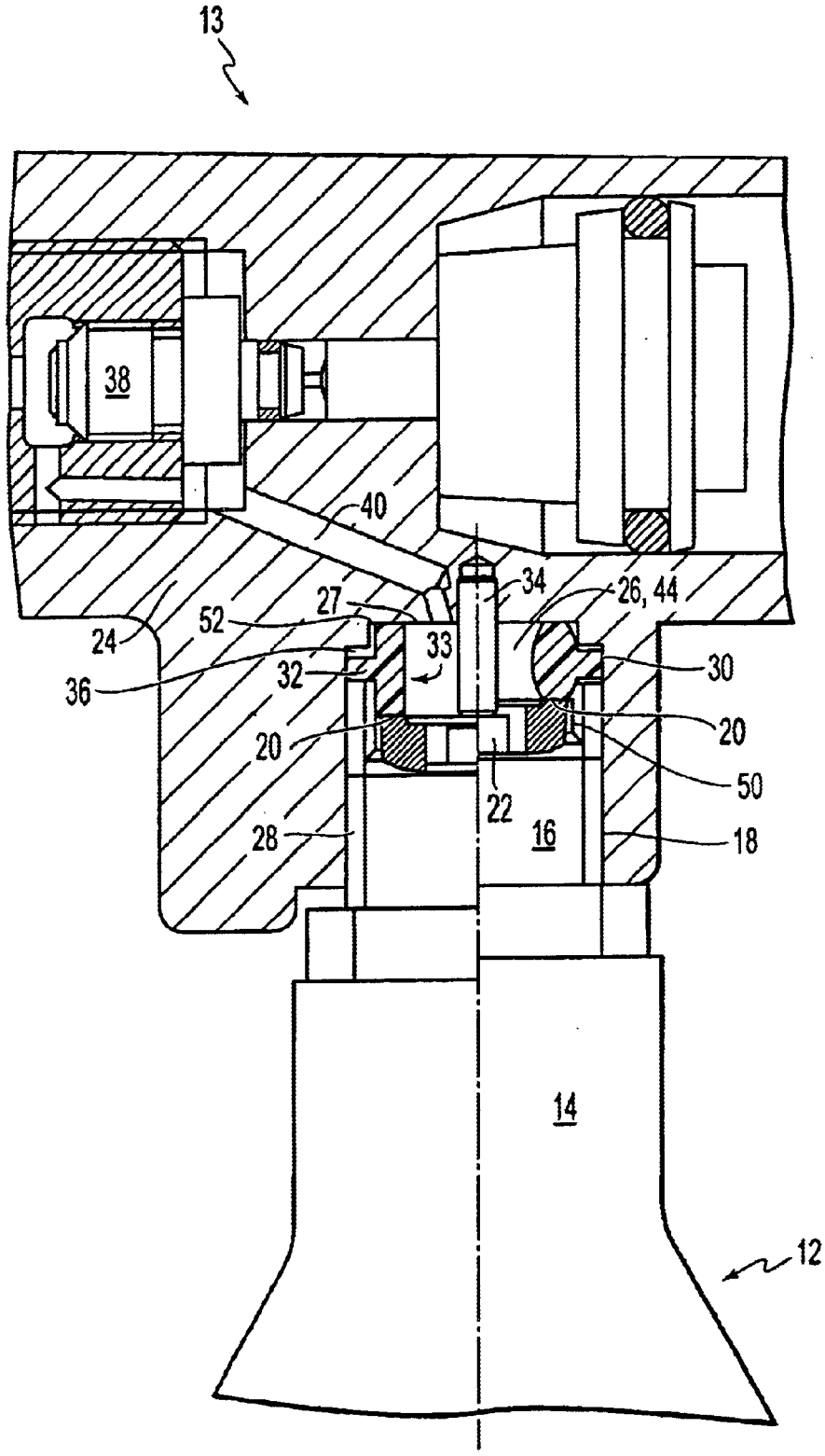
FIG. 1 illustrates a first embodiment of the device according to the invention with a consumer element and a supply container in the not fully screwed-in state and in the fully screwed-in state, in cross section, the supply container only being cross-sectionally illustrated in part.

FIG. 1 shows a first embodiment of the device according to the invention, a supply container 12 in the left-hand part of the figure not being fully screwed into a consumer element 13, and in the right-hand part of the figure being fully screwed into a consumer element 13.

FIG. 1 shows the supply container 12, which is symmetrical about a longitudinal axis L, contains a pressurized medium 14 and has a connection element 16 with an external thread 18 on its neck. On its end side, the connection element 16 has an annular sealing surface 20, and a valve 22 which is enclosed by the annular sealing surface 20.

FIG. 1 also shows a consumer-element body 24 which belongs to the consumer element 13. This consumer-element body has, in its bottom part, a cutout 26 which is essentially cylindrical about the longitudinal axis L and has a base 27. An internal thread 28 is located on the lateral surface of the cutout 26. An encircling groove 30 is located between said internal thread 28 and the base 27. A retaining bead 32 of a sealing element 33 is located in said groove, the retaining bead in the left-hand part of the figure butting against that side wall of the groove which is spaced apart by the greater distance from the base 27. As measured in the direction of the longitudinal axis L, the width of the groove 30 is greater than the width of the retaining bead 32. This provides an amount of play 36 for the retaining bead 32 in the groove 30.

The part of the sealing element 33 outside the groove 30 is, as can be seen in the left-hand part of FIG. 1, rectangular in cross section and has a top annular sealing surface 50, which butts against the base 27, and a bottom annular sealing surface 52, which butts against the end-side sealing surface 20 of the connection element 16. Arranged in the center of the cutout 26 is an opening element 34, in the form of a pin, which extends from the base 27.

Located in the top part of the consumer element 13 is a generally known pressure-reducing element 38, which is in flow connection with the cutout 26 via a connecting through-passage 40. The pressure-reducing element 38 serves for reducing the pressure of the gas flowing out of the supply container 12. An outlet valve through which the gas can flow out into the drink may be connected to the pressure-reducing element 38.

The fully screwed-in state of the supply container 12 is described hereinbelow with reference to the right-hand part of FIG. 1.

The sealing element 33 is deformed and the retaining bead 32 is in contact with that side wall of the groove which is spaced apart by the smaller distance from the base 27 of the cutout 26. In addition, the valve 22 is in the open state. The interior of the supply container 12 is thus connected fluid-dynamically to the interior 44, the connecting through-passage 40 and the pressure-reducing element 38.

The operation of screwing the supply container 12 into the consumer-element body 24 is described hereinbelow.

The external thread 18 of the connection element 16 is screwed into the internal thread 28 of the cutout 26.

In this case, the annular sealing surface 20 on the end side of the supply container 12 comes into abutment with the bottom annular sealing surface 50 of the sealing element 33 and subjects the same to a force in the longitudinal direction L, which deforms the sealing element 33. In this case, the retaining bead 32 of the sealing element 33 moves upwards in the longitudinal Direction L in the encircling groove 30. A displacement of approximately 0.8 mm, which is accommodated by the sealing element 33, produces sealing between the valve 22 of the supply container 12 and the surroundings. The part of the cutout 26 which is in fluid-dynamic contact with the valve 22 at this point in time is referred to as interior 44. As the operation of screwing in the connection element 16 continues, the valve 22 is opened by the opening element 34. The displacement required for this purpose likewise corresponds to approximately 0.8 mm. Following a full displacement, calculated as beginning with the sealing surface 20 of the connection element 16 butting against the sealing element 33, of approximately 1.6 mm, the supply container 12 is screwed into the full extent.

Figure 2:
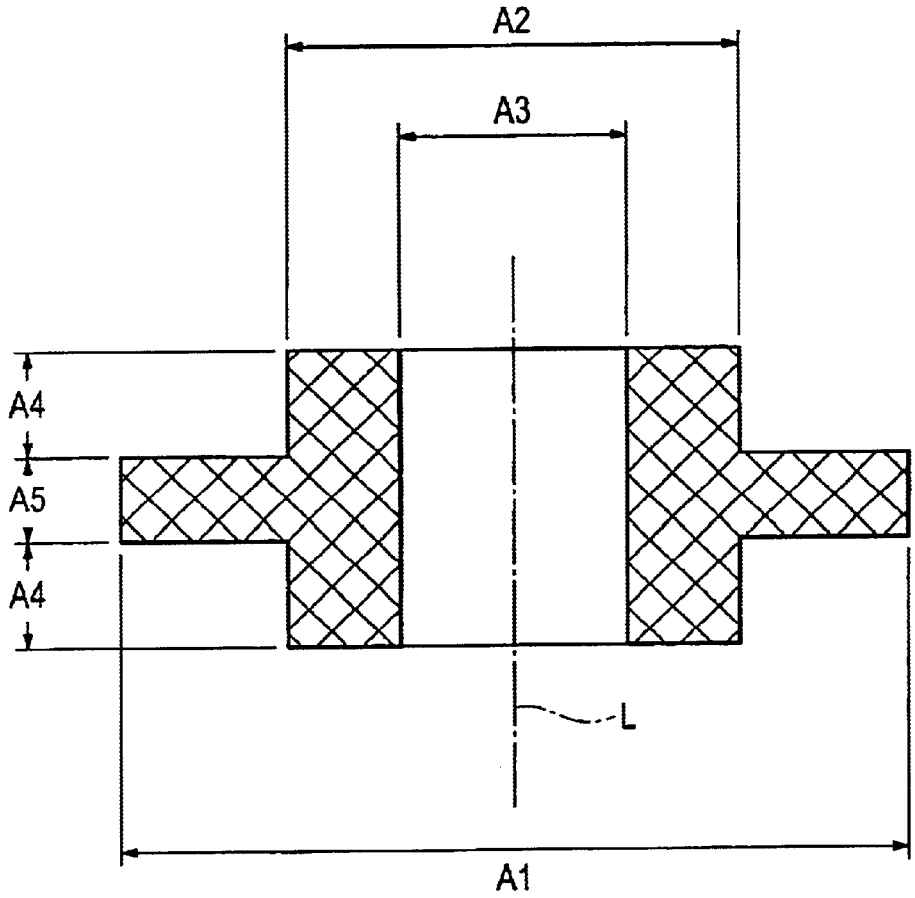
FIG. 2 illustrates a scaling element of the device from FIG. 1 illustrated on an enlarged scale, in cross section.

FIG. 2 illustrates the sealing element 33, as can be seen in FIG. 1, in cross section. Typical dimensions are: A1=21 mm, A2=12 mm, A3=6 mm, A4=3 mm, A5=2 mm. It is quite possible here to deviate from these values.

Figure 3:
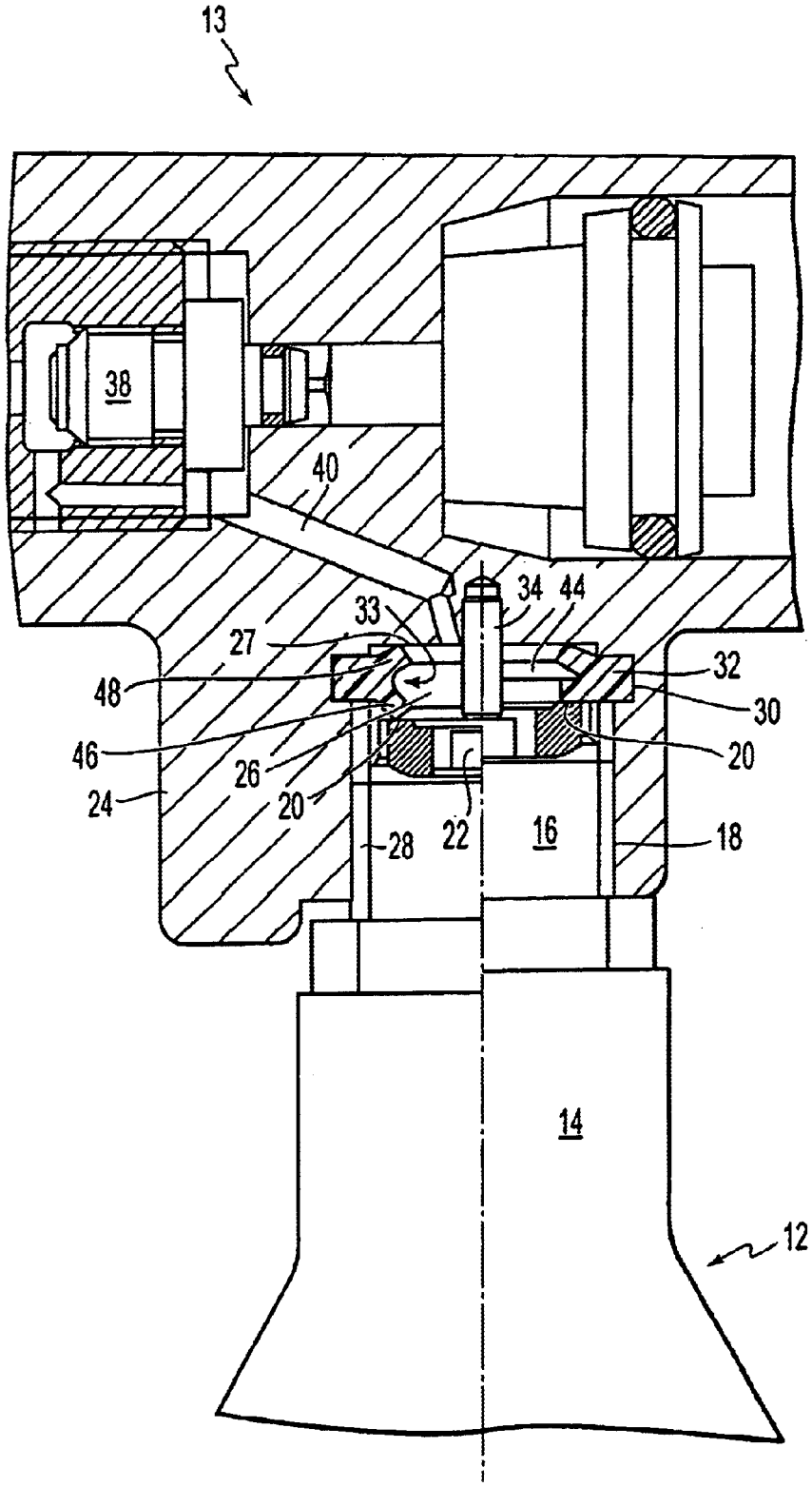
FIG. 3 illustrates a second embodiment of the device according to the invention with a consumer element and a supply container in the not fully screwed-in state and in the fully screwed-in state, in cross section, the supply container only being cross-sectionally illustrated in part.

FIG. 3 illustrates a second embodiment of the device according to the invention. It differs from FIG. 1 in respect of the form of the sealing element 33 and in that there is no amount of play 36 provided for the retaining bead 32 in the encircling groove 30. In the left-hand part of the figure, the supply container 12 is not screwed into the full extent, and in the right-hand part of the figure the supply container 12 is screwed into the full extent. In the case of this embodiment, the sealing element 33 has sealing lips 46, 48 which are V-shaped in cross section.

During the screwing-in operation, the bottom sealing lip 46 comes into contact with the annular sealing surface 20 on the end side of the supply container 12. As the screwing-in operation continues, the bottom sealing lip 46 is moved in the direction of the top sealing lip 48, which is always in contact with the base 27 of the cutout 26. Once the valve 22 of the supply container 12 has been opened, there is a higher pressure in the interior 44 than in the surroundings. This pressure difference induces a force which forces the bottom sealing lip 46 onto the annular sealing surface 20 on the inside of the supply container 12 and the top sealing lip 48 against the base 27, and thus produces full sealing between the interior 44 and the surroundings. In the fully screwed-in state of the supply container 12, the bottom sealing lip 46 rests on the sealing surface 20 such that the normal vector of that part of the surface of the bottom sealing lip which butts against the sealing surface 20 is parallel to the longitudinal axis L.

When the supply container 12 is unscrewed from the consumer element 13, the valve 22 closes before the sealing between the valve 22 and the surroundings is eliminated.

The consumer element 13 may also be, for example, a faucet, a slide or the like. Of course, it is also conceivable for the connection element 16 to be connected to the supply container 12 by means of a line or a tube.

What is claimed is:

1. A device by which a supply container containing a medium subjected to positive pressure is connected in a sealed manner to a consumer element, comprising:

a consumer-element body which has a cutout with an internal thread;

a connection element for connecting to the supply container having a re-sealable valve, an annular sealing surface on an end side, an external thread for being screwed into the internal thread, an opening element connected to the consumer-element body and intended for opening the valve automatically when the connection element is screwed into the consumer-element body, and an annular sealing element which, on the one hand, interacts with sealing interaction with a base of the cutout and on which bottom annular sealing surface the sealing surface comes into abutment when the connection element is screwed in; and wherein the bottom annular sealing surface of the sealing element is arranged in relation to the opening element such that when the connection element is screwed in it interacts with sealing interaction with the sealing surface before the valve is opened and when the connection element is screwed out, the valve is closed before the sealing interaction is eliminated, and the sealing element is designed in order to accommodate at least the displacement for the sealing interaction with the connection element and the opening displacement of the valve.

2. The device as claimed in claim 1, wherein the consumer-element body has an encircling groove between the internal thread and the base, a retaining bead which projects radially outward from the sealing element engaging in said groove.

3. The device as claimed in claim 1, wherein the sealing element is at least substantially rectangular in cross section.

4. The device as claimed in claim 1, wherein the sealing element has sealing lips which are arranged in a V-shaped manner in cross section.

5. The device as claimed in claim 2, wherein the encircling groove, as measured in the longitudinal direction (L) of the cutout, is wider than the retaining bead.

6. The device as claimed in claim 5, wherein, with the connection element unscrewed, the retaining bead butts against a side wall of the encircling groove.

7. The device as claimed in claim 1, wherein the supply container contains carbon dioxide, which preferably serves for carbonating drinks.

8. The device as claimed in claim 1, wherein the consumer element contains a pressure-reducing element.

9. The device as claimed in claim 1, wherein the opening element is a pin fastened on the consumer-element.

10. The device as claimed in claim 2, wherein the sealing element is at least substantially rectangular in cross section.

11. The device as claimed in claim 2, wherein the sealing element has sealing lips which are arranged in a V-shaped manner in cross section.

12. A consumer element comprising:

a consumer-element body which has a cutout with an internal thread intended to receive a connection element of a supply container containing a medium subjected to positive pressure, an opening element connected to the consumer-element body and intended for opening a valve of the connection element automatically when the connection element of the supply container is screwed into the consumer-element body, and an annular sealing element which, on the one hand, interacts with sealing interaction with a base of the cutout and on a bottom annular sealing surface of the annular sealing element a sealing surface of the connection element comes into abutment when the connection element is screwed in; and wherein the bottom annular sealing surface of the annular sealing element is arranged in relation to the opening element such that when the connection element is screwed in it interacts with sealing interaction with the sealing surface before the valve is opened and when the connection element is screwed out the valve is closed before the sealing interaction is eliminated, and the sealing element is designed in order to accommodate at least the displacement for the sealing interaction with the connection element and the opening displacement of the valve.

* * * * *